US008403042B2

(12) United States Patent
Green et al.

(10) Patent No.: US 8,403,042 B2
(45) Date of Patent: Mar. 26, 2013

(54) METHOD AND APPARATUS FOR USE WITH DOWNHOLE TOOLS HAVING GAS-FILLED CAVITIES

(75) Inventors: Taylor Green, Houston, TX (US); Mike Frels, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 205 days.

(21) Appl. No.: 12/835,902

(22) Filed: Jul. 14, 2010

(65) Prior Publication Data

US 2012/0012334 A1 Jan. 19, 2012

(51) Int. Cl.
*E21B 34/06* (2006.01)

(52) U.S. Cl. ..... 166/264; 166/100; 175/58

(58) Field of Classification Search ..... 166/264, 166/100; 175/58

See application file for complete search history.

(56) References Cited

U.S. PATENT DOCUMENTS

| | | | | |
|---|---|---|---|---|
| 4,723,967 | A | 2/1988 | Tom | |
| 4,802,502 | A | 2/1989 | Williams | |
| 5,749,389 | A | 5/1998 | Ritrosi et al. | |
| 6,408,691 | B1 * | 6/2002 | Sorben | 73/152.23 |
| 6,668,924 | B2 * | 12/2003 | Bolze et al. | 166/264 |
| 6,966,348 | B2 | 11/2005 | Steidl et al. | |
| 2008/0087470 | A1 | 4/2008 | Villareal et al. | |

* cited by examiner

*Primary Examiner* — William P Neuder
(74) *Attorney, Agent, or Firm* — Cathy Hewitt; John Vereb

(57) ABSTRACT

Methods and apparatus for use with gas-filled downhole tools are disclosed herein. A disclosed example method includes opening an isolation valve of a downhole tool, wherein the isolation valve is in fluid communication with first and second ports of the downhole tool, and wherein the first and second ports are in fluid communication with respective first and second ends of an interior cavity of the downhole tool; coupling a source of inert gas to the first port and flowing the inert gas into the interior cavity of the downhole tool to expel air from the interior cavity through the second port; closing the second port when the air is expelled from the interior cavity; and closing the isolation valve to seal the inert gas in the interior cavity.

19 Claims, 8 Drawing Sheets

METHOD AND APPARATUS FOR USE WITH DOWNHOLE TOOLS HAVING GAS-FILLED CAVITIES

BACKGROUND OF THE DISCLOSURE

During a drilling operation, it may be desirable to evaluate and/or measure properties of encountered formations and formation fluids. In some cases, a drillstring is removed from a borehole and a wireline tool is deployed into the borehole to test, evaluate and/or sample the formations and/or formation fluid(s). In other cases, the drillstring may be provided with devices to test, evaluate and/or sample the surrounding formations and/or formation fluid(s) without having to remove the drillstring from the borehole. The devices or tools used to test, evaluate and/or sample formations and/or formation fluid(s) often include electronic components disposed within a sealed enclosure or interior cavity.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
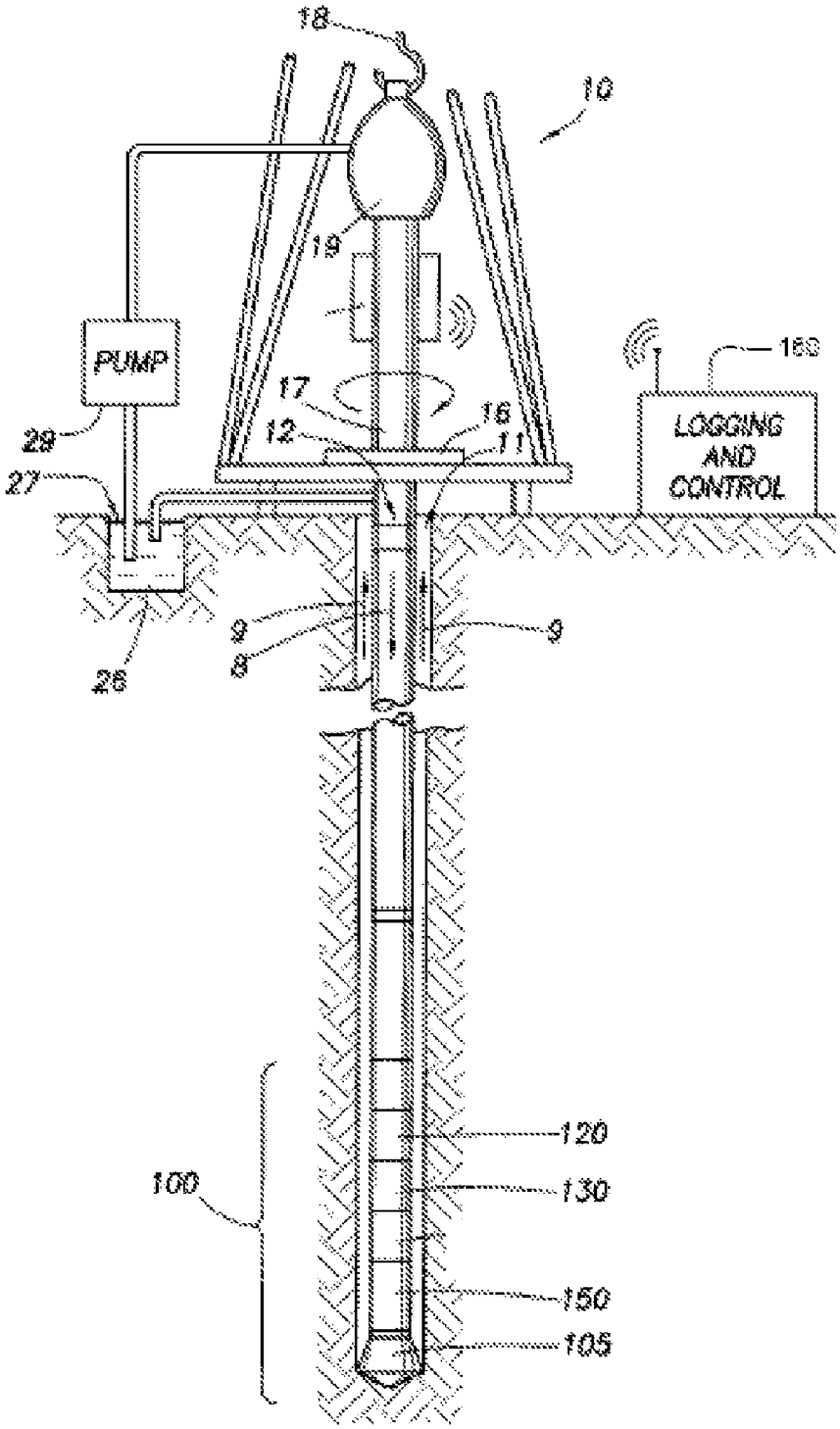
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

One or more aspects of the present disclosure relate to methods and apparatus to purge air, which may include airborne pollutants and/or moisture, from sealed interior spaces or cavities of downhole tools. Electronic components can degrade in the presence of certain airborne pollutants and moisture. The degradation of electronic components by airborne pollutants and moisture may be exacerbated in high-temperature environments encountered by downhole tools. For example, countermeasures, such as desiccant bags, are ineffective at high temperatures. Therefore, purging airborne pollutants and/or moisture may be particularly advantageous for downhole tools having one or more electronic components disposed within interior spaces or cavities of these downhole tools.

According to one or more aspects of this disclosure, a downhole tool having one or more electronic components installed in a sealed interior cavity may be configured to receive an inert gas, such as nitrogen, into the interior cavity. To receive the inert gas, the downhole tool may include an entry port configured to be fluidly coupled to a source of inert gas. The flow of inert gas into the interior cavity may expel atmospheric air, as well as any airborne pollutants and/or moisture suspended or otherwise associated with the air, from the interior cavity through an exit port.

When substantially all of the atmospheric air has been expelled from the interior cavity, the exit port may be closed by, for example, filling the exit port with a plug configured to seal the exit port. Additionally, an isolation valve in fluid communication with the entry port may then be closed to seal the inert gas in the interior cavity. When the isolation valve and the exit port have been closed, thereby sealing the inert gas in the interior cavity, the source of inert gas may be removed or fluidly decoupled from the entry port. The entry port may then be closed by, for example, filling the entry port with a plug configured to seal the entry port. As a result, the interior cavity of the downhole tool may be filled with the inert gas, which has a known purity. Therefore, the contents of the interior cavity are known to exclude airborne pollutants and/or moisture that may be hazardous to electronic components disposed within the interior cavity.

Additionally, the example methods and apparatus described herein may be used to increase a pressure rating of a downhole tool. Before being deployed into a well, the entry port described above may be used to introduce a gas to the interior cavity of the downhole tool to increase pressure within the cavity above atmospheric pressure. For example, when the interior cavity is purged of air and instead filled with an inert gas, an amount of inert gas sufficient to pressurize the interior cavity substantially above an atmospheric pressure may be provided. Thus, when the downhole tool is deployed in a wellbore or borehole, this increased internal pressure decreases a pressure differential between the interior cavity of the downhole tool and an external environment outside the downhole tool. This decreased pressure differential may enable the downhole tool to withstand higher external pressure, such as found within a wellbore or borehole.

Still further, the example methods and apparatus described herein may be used to ensure that a downhole tool has been properly assembled. For example, the example methods and apparatus described herein may be used to determine whether an interior cavity of the downhole tool is sealed. To make this determination, the entry port described herein may be configured to receive a pressure source capable of lowering the pressure within the interior cavity of the downhole tool below, for example, an atmospheric pressure. If the interior cavity of the downhole tool is properly sealed, the pressure within the interior cavity will drop in response to the pressure source being coupled to the entry port. On the other hand, if the interior cavity of the downhole tool is improperly sealed, the pressure within the interior cavity will fail to drop sufficiently in response to the pressure source being coupled to the entry port.

FIG. 1 depicts a wellsite system including downhole tool(s) that may be purged according to one or more aspects of the present disclosure. The wellsite drilling system of FIG. 1 can be employed onshore and/or offshore. In the example wellsite system of FIG. 1, a borehole 11 is formed in one or more subsurface formations by rotary and/or directional drilling.

As illustrated in FIG. 1, a drill string 12 is suspended in the borehole 11 and includes a bottom hole assembly (BHA) 100 having a drill bit 105 at its lower end. A surface system includes a platform and derrick assembly 10 positioned over the borehole 11. The derrick assembly 10 includes a rotary table 16, a kelly 17, a hook 18 and a rotary swivel 19. The drill string 12 is rotated by the rotary table 16, energized by means not shown, which engages the kelly 17 at an upper end of the drill string 12. The example drill string 12 is suspended from the hook 18, which is attached to a traveling block (not shown), and through the kelly 17 and the rotary swivel 19, which permits rotation of the drill string 12 relative to the hook 18. Additionally, or alternatively, a top drive system could be used.

In the example depicted in FIG. 1, the surface system further includes drilling fluid 26, which is commonly referred to in the industry as "mud," and which is stored in a pit 27 formed at the well site. A pump 29 delivers the drilling fluid 26 to the interior of the drill string 12 via a port in the rotary swivel 19, causing the drilling fluid 26 to flow downwardly through the drill string 12 as indicated by the directional arrow 8. The drilling fluid 26 exits the drill string 12 via ports in the drill bit 105, and then circulates upwardly through the annulus region between the outside of the drill string 12 and the wall of the borehole 11, as indicated by the directional arrows 9. The drilling fluid 26 lubricates the drill bit 105, carries formation cuttings up to the surface as it is returned to the pit 27 for recirculation, and creates a mudcake layer (not shown) on the walls of the borehole 11.

The example bottom hole assembly 100 of FIG. 1 includes, among other things, any number and/or type(s) of logging-while-drilling (LWD) modules or tools (one of which is designated by reference numeral 120) and/or measuring-while-drilling (MWD) modules (one of which is designated by reference numeral 130), a rotary-steerable system or mud motor 150 and the example drill bit 105. The MWD module 130 measures the drill bit 105 azimuth and inclination that may be used to monitor the borehole trajectory.

The example LWD tool 120 and/or the example MWD module 130 of FIG. 1 may be housed in a special type of drill collar, as it is known in the art, and contains any number of logging tools and/or fluid sampling devices. The example LWD tool 120 includes capabilities for measuring, processing and/or storing information, as well as for communicating with the MWD module 130 and/or directly with the surface equipment, such as, for example, a logging and control computer 160.

The logging and control computer 160 may include a user interface that enables parameters to be input and or outputs to be displayed that may be associated with the drilling operation and/or the formation traversed by the borehole 11. While the logging and control computer 160 is depicted uphole and adjacent the wellsite system, a portion or all of the logging and control computer 160 may be positioned in the bottom hole assembly 100 and/or in a remote location.

Figure 2:
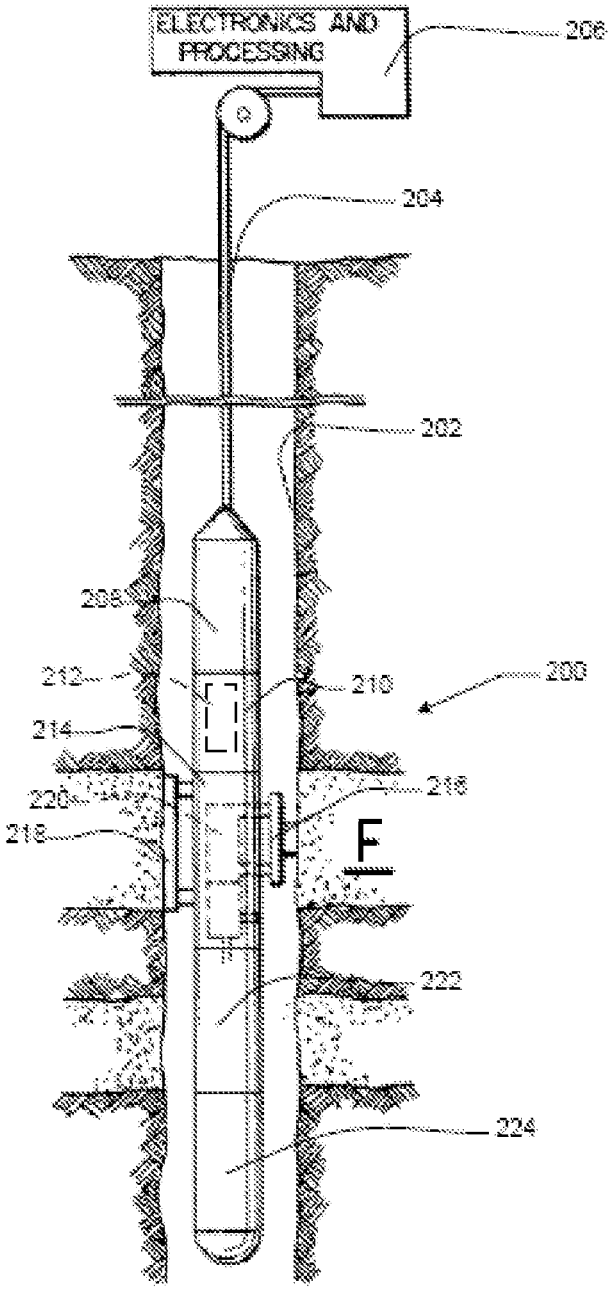
FIG. 2 is a schematic view of apparatus according to one or more aspects of the present disclosure.

FIG. 2 depicts an example wireline system including downhole tool(s) that may be purged according to one or more aspects of the present disclosure. The example wireline tool 200 may be used to extract and analyze formation fluid samples and is suspended in a borehole or wellbore 202 from the lower end of a multiconductor cable 204 that is spooled on a winch (not shown) at the surface. At the surface, the cable 204 is communicatively coupled to an electrical control and data acquisition system 206. The tool 200 has an elongated body 208 that includes a collar 210 having a tool control system 212 configured to control extraction of formation fluid from a formation F and measurements performed on the extracted fluid.

The wireline tool 200 also includes a formation tester 214 having a selectively extendable fluid admitting assembly 216 and a selectively extendable tool anchoring member 218 that are respectively arranged on opposite sides of the body 208. The fluid admitting assembly 216 is configured to selectively seal off or isolate selected portions of the wall of the wellbore 202 to fluidly couple to the adjacent formation F and draw fluid samples from the formation F. The formation tester 214 also includes a fluid analysis module 220 through which the obtained fluid samples flow. The fluid may thereafter be expelled through a port (not shown) or it may be sent to one or more fluid collecting chambers 222 and 224, which may receive and retain the formation fluid for subsequent testing at the surface or a testing facility.

In the illustrated example, the electrical control and data acquisition system 206 and/or the downhole control system 212 are configured to control the fluid admitting assembly 216 to draw fluid samples from the formation F and to control the fluid analysis module 220 to measure the fluid samples. In some example implementations, the fluid analysis module 220 may be configured to analyze the measurement data of the fluid samples as described herein. In other example implementations, the fluid analysis module 220 may be configured to generate and store the measurement data and subsequently communicate the measurement data to the surface for analysis at the surface. Although the downhole control system 212 is shown as being implemented separate from the formation tester 214, in some example implementations, the downhole control system 212 may be implemented in the formation tester 214.

One or more modules or tools of the example drill string 12 shown in FIG. 1 and/or the example wireline tool 200 of FIG. 2 may employ the example methods and apparatus described herein to purge an interior cavity of a downhole tool of air and any airborne pollutants and/or moisture, increase a pressure rating of a downhole tool, and/or verify that a downhole tool is properly sealed. For example, one or more of the LWD tool 120 (FIG. 1), the MWD module 130 (FIG. 1), the tool control system 212 (FIG. 2), and/or the formation tester 214 (FIG. 2) may utilize the example methods and apparatus described herein. While the example apparatus and methods described herein are described in the context of drillstrings and/or wireline tools, they are also applicable to any number and/or type(s) of additional and/or alternative downhole tools such as coiled tubing deployed tools. Further, one or more aspects of this disclosure may also be used in other coring applications such as side-wall and/or in-line coring.

Figure 3:
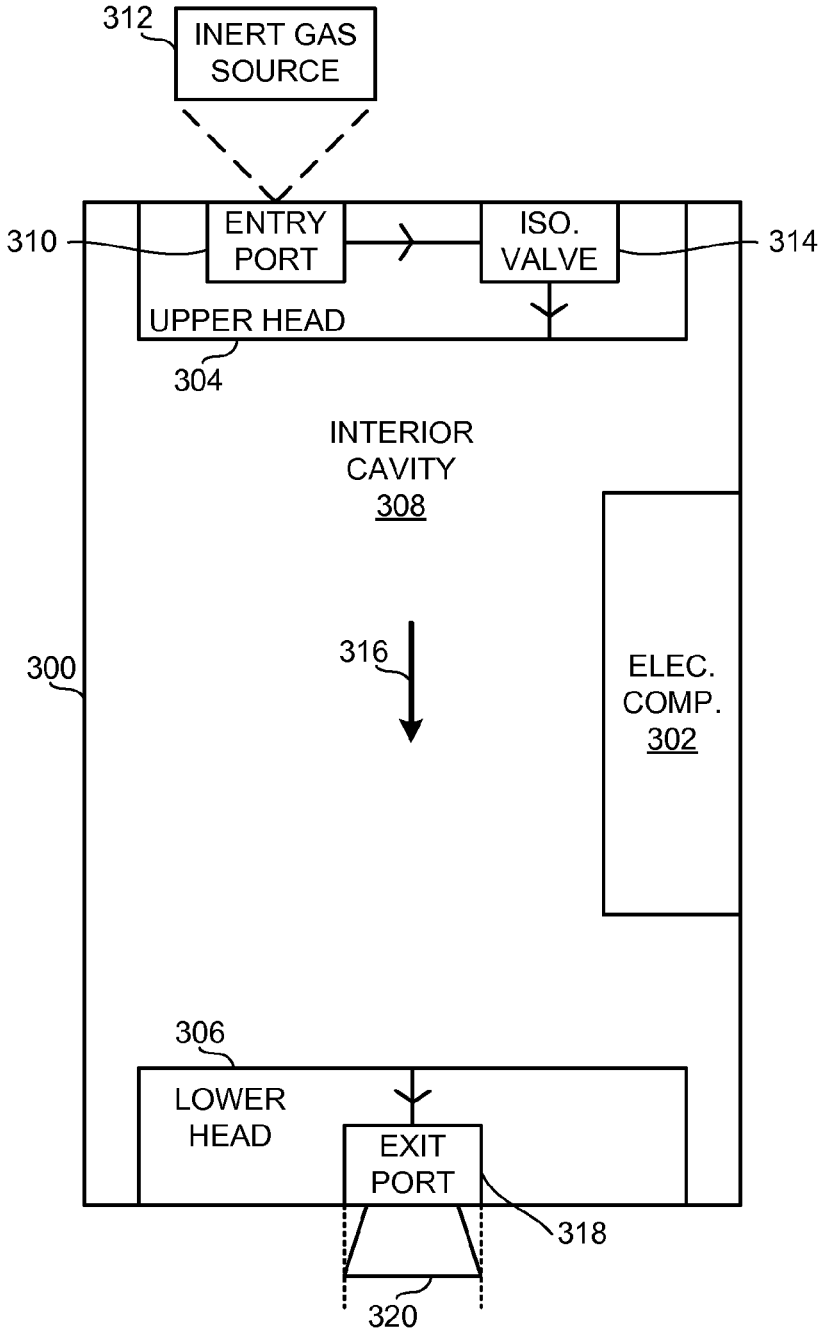
FIG. 3 is a schematic view of apparatus according to one or more aspects of the present disclosure.

FIG. 3 is a block diagram illustrating an example downhole tool 300 configured according to one or more aspects of the present disclosure. The example of FIG. 3 may be representative of one or more of the LWD tool 120 (FIG. 1), the MWD module 130 (FIG. 1), the tool control system 212 (FIG. 2), and/or the formation tester 214 (FIG. 2) described above in FIGS. 1 and/or 2.

The example downhole tool 300 of FIG. 3 includes one or more electronic components 302, an upper head 304 and a lower head 306 disposed adjacent to or in an interior cavity 308. The upper head 304 may be associated with a box end of the downhole tool 300 and the lower head 306 may be associated with a pin end of the downhole tool 300. The example electronic component(s) 302 may be configured to implement or manage one or more of the functions described above in connection with FIGS. 1 and/or 2. For example, when the example downhole tool 300 of FIG. 3 represents the formation tester 214 of FIG. 2, the electronic component(s) 302 may operate an extension of the fluid admitting assembly 216 into engagement with the formation F and/or other functions of the formation tester 214. Alternatively, when the example downhole tool 300 of FIG. 3 represents the MWD tool 130 of FIG. 1, the electronic component(s) 302 may manage a communication of data with the logging and control computer 160 at the surface and/or other functions of the MWD tool 130. However, the example electronic component(s) 302 of FIG. 3 may be additional or alternative equipment configured to operate or implement additional or alternative functionality of a downhole tool.

As described above, the presence of airborne pollutants and/or moisture in the interior cavity 308 can adversely affect the electronic component(s) 302, particularly under the environmental conditions in a wellbore or borehole. Therefore, the example downhole tool 300 of FIG. 3 is configured to replace the atmospheric air of the interior cavity 308, along with the pollutants and moisture therein, with a gas having a known purity. To receive the gas, the upper head 304 includes an entry port 310. In the illustrated example, the entry port 310 is configured to detachably engage or couple fluidly to an inert gas source 312 capable of delivering a steady flow of, for example, nitrogen to the entry port 310 when coupled thereto.

The example entry port 310 may be configured to removably engage additional or alternative devices. For example, the example entry port 310 may be configured to engage a pressure source (not shown) to determine whether the interior cavity 308 of the downhole tool 300 is properly sealed. To make this determination, the pressure source is fluidly coupled to the entry port 310 and acts to lower the pressure of the interior cavity 308, for example, at a predetermined rate. If the pressure of the interior cavity 308 drops at a rate different from the predetermined rate, the downhole tool 300 is not properly sealed. Otherwise, if the pressure of the interior cavity 308 drops at the predetermined rate or within a threshold of the predetermined rate, the downhole tool 300 is properly sealed. The example downhole tool 300 of FIG. 3 and/or the pressure source may include pressure and/or temperature sensors capable of calculating a pressure within the interior cavity 308, detecting a change in pressure in the interior cavity 308, and/or calculating a rate of change associated with the pressure of the interior cavity 308. Signals or data from such sensors may also be used to compare the measured or calculated rate of pressure change with the predetermined rate. While the pressure source may act to lower the pressure of the interior cavity 308 to determine whether the downhole tool 300 is not properly sealed, the pressure source may alternatively or additionally act to increase the pressure of the interior cavity 308 to determine whether the downhole tool 300 is not properly sealed.

Additionally, or alternatively, the example entry port 310 may be configured to engage a pressure source to increase a pressure rating of the downhole tool 300. For example, the pressure within the interior cavity 308 can be increased via the pressure source, thereby reducing a pressure differential between the interior cavity 308 and a high-pressure external environment, such as the borehole 11 of FIG. 1. Some downhole tools include multiple concentric cavities extending throughout the interior of the tool. Such downhole tools have an inner cavity of a first diameter within an outer cavity of a second, larger diameter. In such instances, the pressure of the inner cavity can be increased using the example methods and apparatus described herein to decrease the pressure differential between the inner and outer cavities. Thus, the higher pressure of the outer cavity imposed by the environment external to the downhole tool is less likely to adversely affect the inner cavity.

The upper head 304 of the example downhole tool 300 also includes an isolation valve 314 in fluid communication with the entry port 310 and the interior cavity 308. Thus, the isolation valve 314 is capable of isolating the entry port 310 from the interior cavity 308. However, when the isolation valve 314 is open and the inert gas source 312 is coupled to the entry port 310, the inert gas flows through the entry port 310 and the isolation valve 314 into the interior cavity 308 in a direction indicated by an arrow 316.

When the example downhole tool 300 is being purged using the example methods and apparatus described herein, the inert gas fills the interior cavity 308 and forces the atmospheric air (as well as any airborne pollutants or moisture) within the interior cavity 308 toward the lower head 306. In the illustrated example, the lower head 306 includes an exit port 318 in fluid communication with the interior cavity 308. When the exit port 318 is open and the inert gas is flowing into the interior cavity 308 from the isolation valve 314, atmospheric air is expelled through the exit port 318 until substantially all, if not all, of the interior cavity 308 is filled with the inert gas. Once the interior cavity 308 is at least substantially full of the inert gas, the exit port 318 can be shut or closed to prevent air flow to and from the interior cavity 308 via the exit port 318. In the illustrated example, the exit port 318 is sealed shut using a plug 320 configured to engage the exit port 318. The example plug 320 includes a threaded portion configured to mate with a correspondingly threaded portion of the exit port 320. The example exit port 318 may be sealed closed using other suitable device(s) or method(s).

When the example downhole tool 300 is being purged using the example methods and apparatus described herein and the exit port 318 has been sealed using the plug 320, the isolation valve 314 may be closed. Because the exit port 318 and the isolation valve 314 are the only points of entry for gas flow into the interior cavity 308, the inert gas forced into the interior cavity 308 as described above is sealed therein. Once the isolation valve 314 is shut to seal the inert gas in the interior cavity 308, the entry port 310 can be shut or closed. In the illustrated example, the entry port 310 is sealed shut or closed using a plug (not shown) configured to engage the entry port 310. A plug similar to the threaded plug 320 used to seal the exit port 318 may be used to seal the entry port 310. Alternatively, the example entry port 310 may be sealed shut using other suitable device(s) or method(s).

Figure 4:
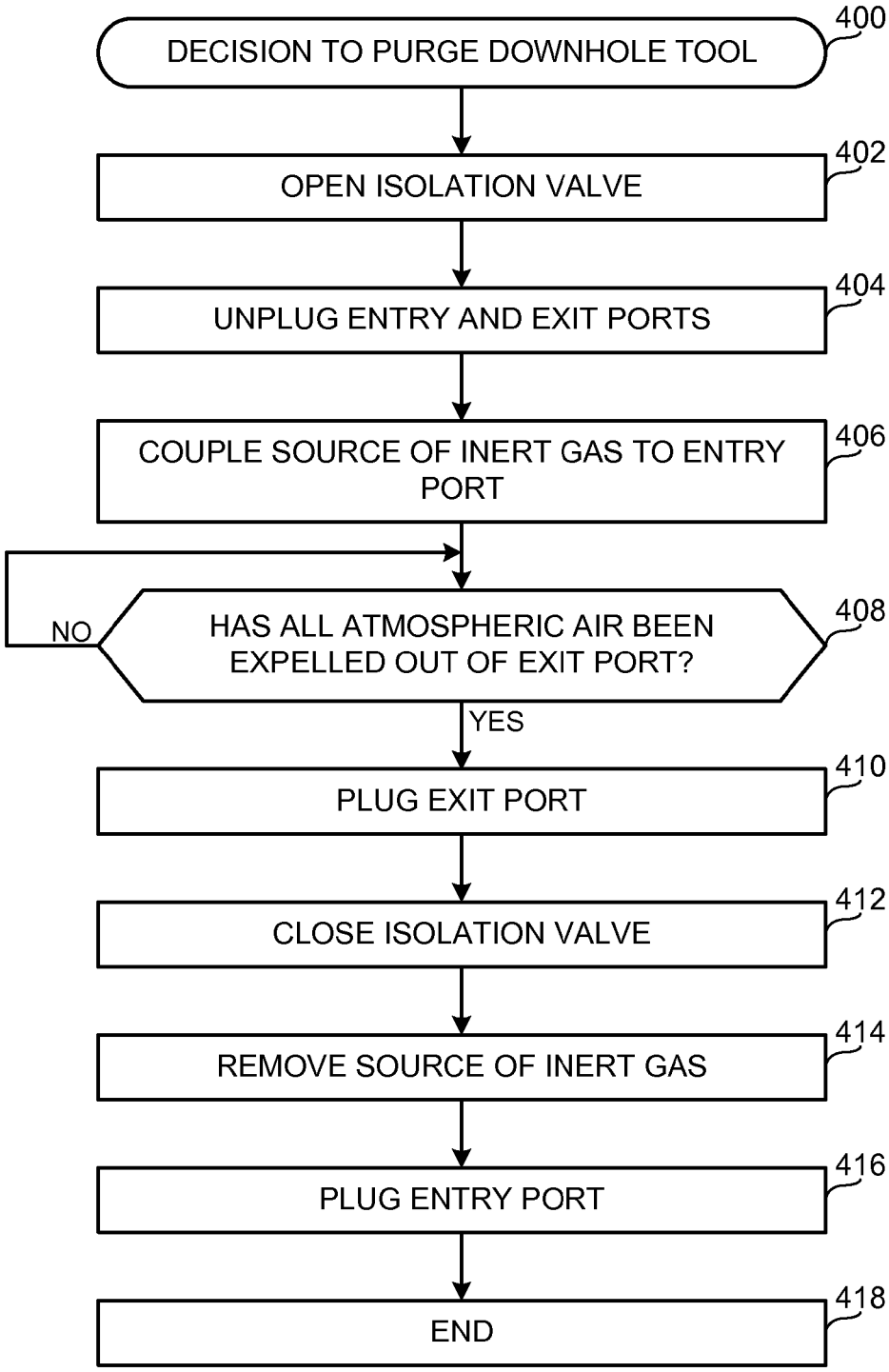
FIG. 4 is a flow-chart diagram of at least a portion of a method according to one or more aspects of the present disclosure.

FIG. 4 is a flow diagram representative of an example process that may be implemented according to one or more aspects of the present disclosure to expel or purge airborne pollutants and/or moisture from an interior cavity of a downhole tool. For purposes of illustration, the example process of FIG. 4 is described below in conjunction with the example downhole tool 300 of FIG. 3. However, the example process of FIG. 4 may be implemented in conjunction with one or more other downhole tools of, for example, a drill string and/or wireline tool(s).

To begin the example process of FIG. 4, a decision is made to purge the downhole tool 300 (block 400). This decision may be made when the downhole tool 300 is uphole and is being prepared to be deployed into a borehole, such as the borehole 11 of FIG. 1. As described above, the electronic component(s) 302 of the downhole tool 300 may benefit from replacing the atmospheric air of the interior cavity 308 with an inert gas of a known purity. Therefore, the decision made at block 400 may be made to ensure the continued integrity of the electronic component(s) 302.

To prepare the downhole tool 300 to receive an inert gas, such as nitrogen, the isolation valve 314 is opened (block 402). Furthermore, the entry port 310 and the exit port 318 are also opened (block 404). In the illustrated example of FIG. 4, the entry port 310 and the exit port 318 are opened by removing respective plugs therefrom. As shown in FIG. 3, the plug 320 and another plug may be configured to seal the exit port 318 and the entry port 310, respectively. Additional or alternative devices or methods may be used to seal and/or open the entry and exit ports 310 and 318.

Once the isolation valve 314, the entry port 310 and the exit port 318 are open, the inert gas source 312 is fluidly coupled to the entry port 310 (block 406). As described above, inert gas flows from the entry port 310, through the isolation valve 314 and into the interior cavity 308. The inert gas begins filling the interior cavity 308 in the direction of the arrow 316, thereby forcing the atmospheric air in the interior cavity 308 out of the exit port 318.

When substantially all, if not all, of the atmospheric air is expelled from the interior cavity 308 (block 408), the exit port 318 is closed (block 410). The decision made at block 408 may be based on a suitable measurement or calculation capable of determining the substantial contents of the interior cavity 308. For example, the decision made at block 408 may be in terms of whether the entire interior cavity 308 is filled with the inert gas by monitoring a gas concentration at the exit port 318 and/or lower head 306. That is, as the inert gas flows through the interior cavity 308 in the direction of the arrow 316 of FIG. 3, if the exit port 318 and/or the lower head 306 is surrounded by the inert gas, the decision at block 408 may result in a determination that substantially all of the atmospheric air has been expelled out of the exit port 318. Additionally, or alternatively, the decision made at block 408 may be based on an amount of time the inert gas has been flowing into the interior cavity 308, a volume of the interior cavity 308, a volume of flow of the inert gas into the interior cavity 308, a pressure within the interior cavity 308 indicated by a pressure sensor associated with the interior cavity 308, and/or a combination of these or other suitable measurement(s) or calculation(s).

In the illustrated example, the exit port 318 is plugged using the example plug 320 that was removed from the exit port 318 at block 404 above. However, alternative devices and/or methods may be used to close the exit port 318. After the exit port 318 has been sealed to prevent escape of the inert gas from the interior cavity 308 to the external environment, the isolation valve 314 is closed (block 412). At this point, the interior cavity 308 is sealed and substantially full of the inert gas. Therefore, the source of inert gas 312 is removed or decoupled from the entry port 310 (block 414) and the entry port 310 is sealed (block 416). In the illustrated example of FIG. 4, the entry port 310 is sealed using a plug similar to the threaded plug 320 used to seal the exit port 318. However, alternative devices and/or methods may be used to seal the entry port 310.

Figure 5:
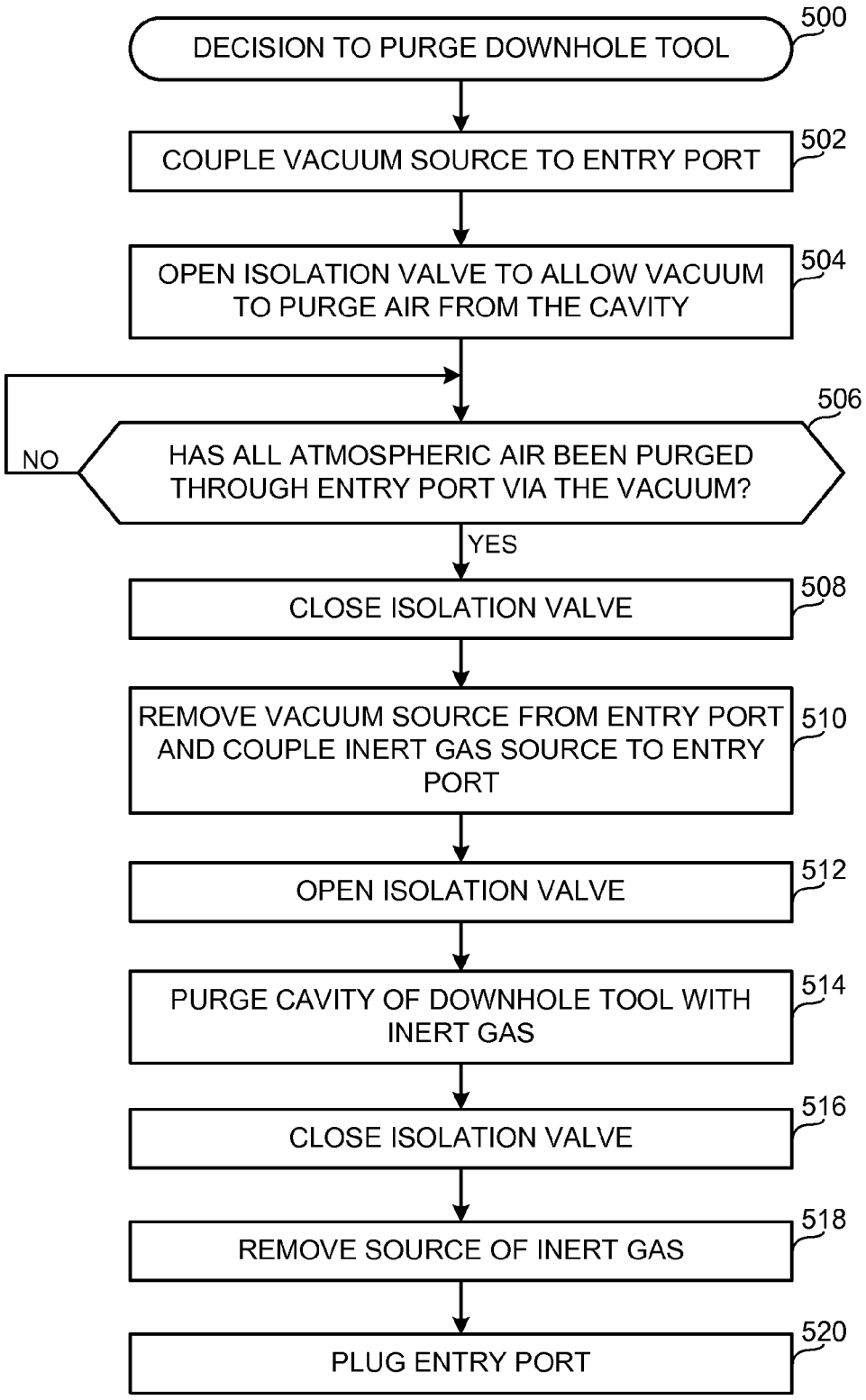
FIG. 5 is a flow-chart diagram of at least a portion of a method according to one or more aspects of the present disclosure.

FIG. 5 is a flow diagram representative of an example process that may be implemented according to one or more aspects of the present disclosure to expel or purge airborne pollutants and/or moisture from an interior cavity of a downhole tool. The example process of FIG. 5 may be implemented in conjunction with one or more downhole tools of, for example, a drill string and/or wireline tool(s) within the scope of the present disclosure.

Generally, the example process of FIG. 5 involves using a source of vacuum pressure to extract atmospheric air as well as other contaminants from a downhole tool, such as the example downhole tool 300 of FIG. 3, prior to filling the downhole tool 300 with an inert gas. The example process of FIG. 5 may be implemented in a downhole tool similar to the example downhole tool 300 of FIG. 3. In such instances, the exit port 318 remains plugged throughout the example process of FIG. 5. Alternatively, the example process of FIG. 5 may be implemented in a downhole tool having an entry port, but not having an exit port similar to the example exit port 318 of FIG. 3. That is, the example process of FIG. 5 may be implemented in a downhole tool having a single port to which a source of vacuum pressure and a source of pressurized inert gas are sequentially coupled.

To begin the example process of FIG. 5, a decision is made to purge the downhole tool 300 (block 500). This decision may be made when the downhole tool 300 is uphole and is being prepared to be deployed into a borehole, such as the borehole 11 of FIG. 1. As described above, the decision made at block 500 may be made to ensure the continued integrity of the electronic component(s) 302 disposed within the downhole tool 300.

To extract or purge atmospheric air from a cavity of the downhole tool 300, a source of vacuum pressure is coupled to the entry port 310 of the downhole tool 300 (block 502). The isolation valve 314 is then opened to allow the vacuum to extract or purge any air from the cavity 308 (block 504). In this manner, the vacuum source removes contaminants from the cavity 308 by vaporizing and/or drawing the contaminants out of the cavity 308. When substantially all, if not all, of the atmospheric air and/or other contaminants have been expelled from the interior cavity 308 (block 506), the isolation valve 314 is closed (block 508).

The cavity 308 may then be filled using a source of inert gas 312. In the illustrated example of FIG. 5, the vacuum source is removed from the entry port 310 and the inert gas source 312 is coupled to the entry port 310 (block 510). The isolation valve 314 is opened to allow the inert gas to reach the cavity 308 (block 512). The inert gas then fills the cavity 308 (block 514) and the isolation valve is closed (block 516). Therefore, contaminants have been removed from the cavity 308 via the vacuum procedure performed at block 504 and the cavity 308 has been filled with a gas of known purity at block 514.

To conclude the example process of FIG. 5, the inert gas source 312 is removed from the entry port 310 (block 520), which is then plugged (block 520).

Figure 6:
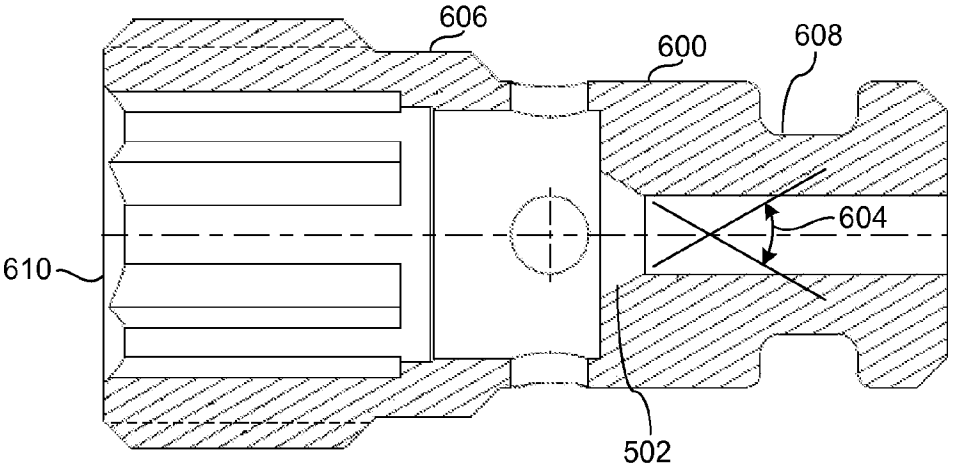
FIG. 6 is a schematic view of apparatus according to one or more aspects of the present disclosure.
Figure 7:
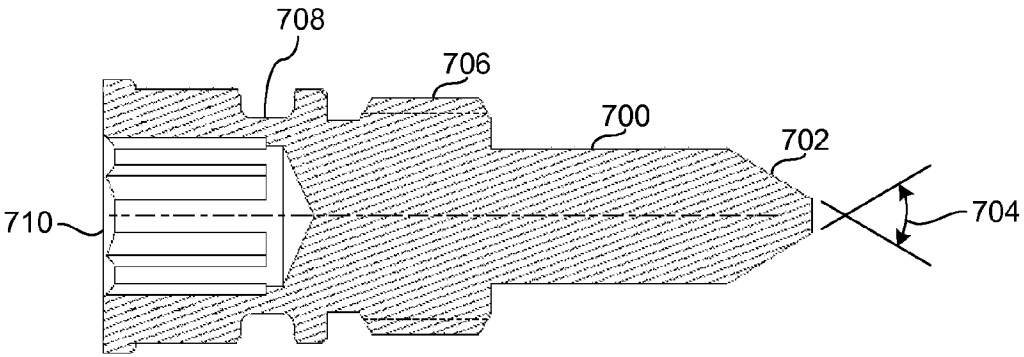
FIG. 7 is a schematic view of apparatus according to one or more aspects of the present disclosure.

FIG. 6 illustrates an example seat 600 that may be used to implement the example isolation valve 314 of FIG. 3. FIG. 7 illustrates an example stem 700 that may be used to implement the example isolation valve 314 of FIG. 3. The example seat 600 of FIG. 6 may be installed in the downhole tool 300 as part of an interface section configured to engage, for example, another downhole tool or another segment of a drillstring or wireline tool. The example stem 700 of FIG. 7 is configured to engage the example seat 600 of FIG. 6 to form the isolation valve 314 of FIG. 3.

As shown in the example of FIG. 6, a sealing surface 602 of the seat 600 is tapered at a first angle 604. As shown in the example of FIG. 7, a plug portion 702 of the stem 700 is tapered at a second angle 704. In the illustrated example, the second angle 704 of the plug portion 702 is different than the first angle 604 of the sealing surface 602. For example, the second angle 704 may be greater than the first angle 604 by a certain amount, such as two degrees. The differing angles 604 and 704 enable to the plug portion 702 of the stem 700 to engage the sealing surface 602 of the seat 600 along an annular line to form a tight seal.

A body 606 of the example seat 600 includes an annular groove 608 configured to receive a sealing member, such as an O-ring. The sealing member to be received by the annular groove 608 is capable of forming a seal between the body 606 of the seat 600 and an internal surface of the downhole tool 300, such as an annular portion of the upper head 304 of FIG. 3. The example seat 600 also includes a recessed space 610 configured to receive a tool, such as an Allen wrench or hex key. The tool can be inserted into the recessed space 610 for purposes of assembling the example seat 600 into the downhole tool 300.

A body 706 of the example stem 700 also includes an annular groove 708 configured to receive a sealing member, such as an O-ring. The sealing member to be received by the annular groove 708 of the example stem 700 is capable of forming a seal between the body 706 of the stem 700 and an internal surface of the seat 600. Additionally, or alternatively, the seat 600 and the stem 700 may be coupled via complimentary threaded portions thereof. The example stem 700 also includes a recessed space 710 configured to receive a tool, such as an Allen wrench or hex key. The tool can be inserted into the recessed space 710 for purposes of opening and closing the isolation valve 314 by seating the stem 700 into the seat 600 and unseating the stem 700 from the seat 600, respectively.

Figure 8:
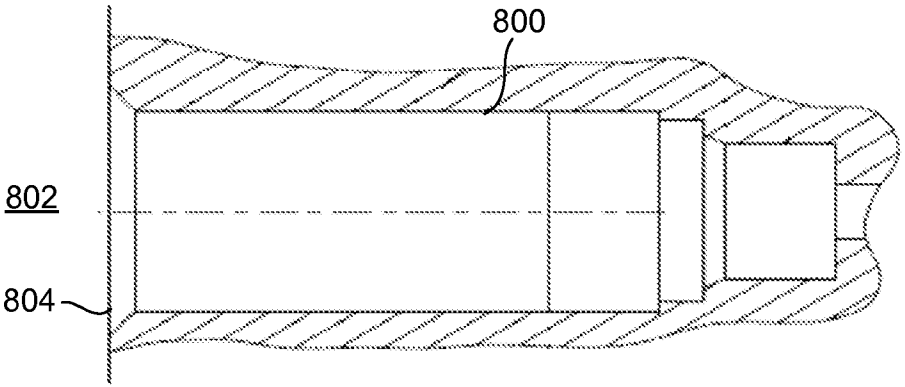
FIG. 8 is a schematic view of apparatus according to one or more aspects of the present disclosure.

FIG. 8 illustrates an example port 800 that may be used to implement the example exit port 318 of FIG. 3. The example port 800 may be installed in the downhole tool 300 as part of an interface section configured to engage, for example, another downhole tool or another segment of a drillstring or wireline tool. To expel atmospheric air as described above in connection with FIGS. 3-5, the example port 800 of FIG. 8 is in fluid communication with an external environment 802 adjacent an end 804 of the downhole tool 300.

Figure 9:
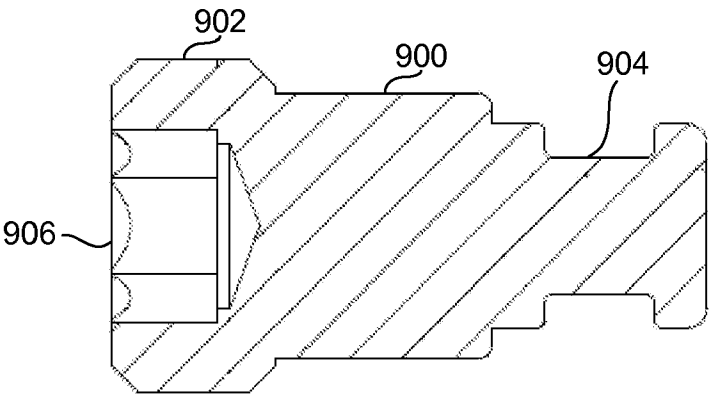
FIG. 9 is a schematic view of apparatus according to one or more aspects of the present disclosure.

FIG. 9 illustrates an example plug 900 that may be used to implement the example plug 320 of FIG. 3. A body 902 of the example plug 900 includes an annular groove 904 configured to receive a sealing member, such as an O-ring. The sealing member to be received by the annular groove 904 of the example plug 900 is capable of forming a seal between the body 902 of the plug 900 and an internal surface of the example exit port 800 of FIG. 8 and the example exit port 318 of FIG. 3 or the example entry port 310 of FIG. 3. Additionally, or alternatively, the example plug 900 may include a threaded portion to engage a complimentary threaded portion of the example exit port 800 of FIG. 8 and the example exit port 318 of FIG. 3 or the example entry port 310 of FIG. 3. The example plug 900 also includes a recessed space 906 configured to receive a tool, such as an Allen wrench or hex key. The tool can be inserted into the recessed space 906 for purposes of coupling or decoupling the example plug 900 to or from the example exit port 800 of FIG. 8 and the example exit port 318 of FIG. 3 or the example entry port 310 of FIG. 3.

Figure 10:
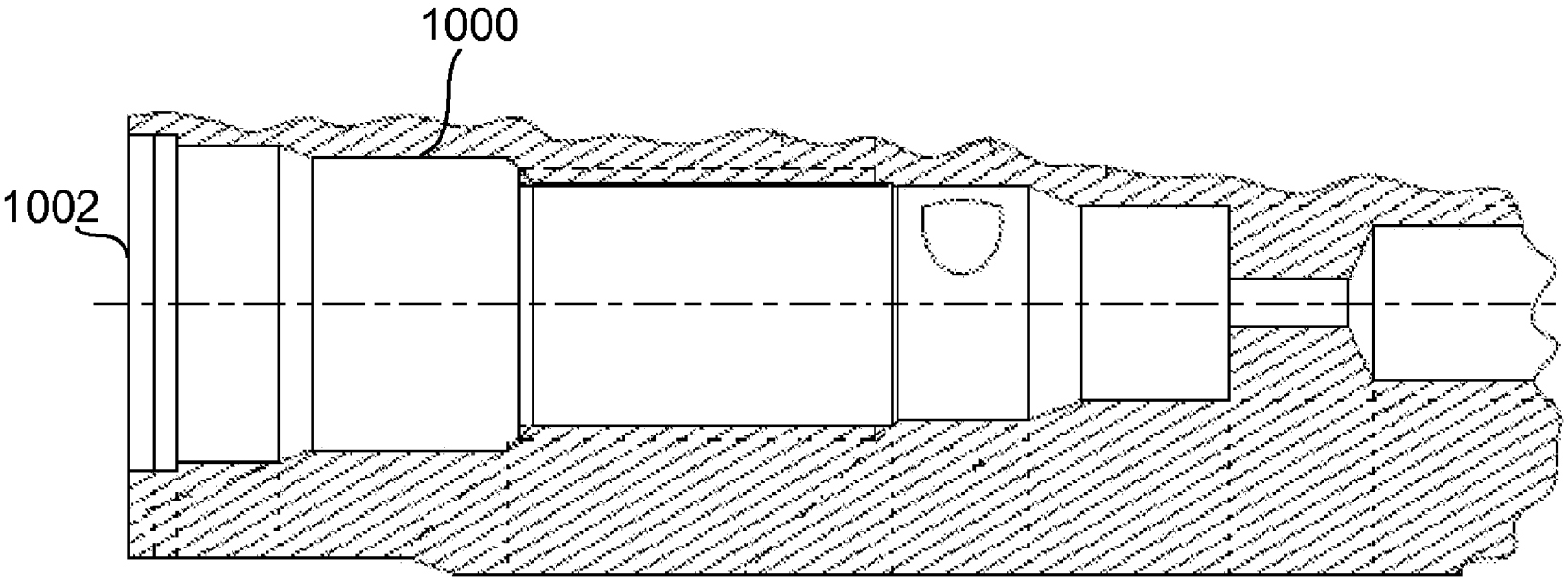
FIG. 10 is a schematic view of apparatus according to one or more aspects of the present disclosure.

FIG. 10 illustrates an example port 1000 that may be used to implement the example entry port 310 of FIG. 3. The example port 1000 of FIG. 10 may be placed in fluid communication with the example isolation valve 314 of FIG. 3 (which is also represented by the example seat 600 of FIG. 6 and the example stem 700 of FIG. 7). An end of the example port 1000 of FIG. 10 is configured to receive one or more devices, such as the inert gas source 312 of FIG. 3 and/or a pressure source, at a first end 902. As described above, the inert gas source 312 to be received at the first end 1002 of the example port 1000 may be used to purge the corresponding downhole tool 300 of substantially all, if not all, airborne pollutants and/or moisture. Additionally, the pressure source to be received at the first end 1002 of the example port 1000 may be used to verify a proper seal of the interior cavity 308 and/or to increase the pressure rating of the downhole tool 300.

In view of the foregoing description and the figures, it should be clear that the present disclosure introduces a method comprising: opening an isolation valve of a downhole tool, wherein the isolation valve is in fluid communication with first and second ports of the downhole tool, and wherein the first and second ports are in fluid communication with respective first and second ends of an interior cavity of the downhole tool; coupling a source of inert gas to the first port and flowing the inert gas into the interior cavity of the downhole tool to expel air from the interior cavity through the second port; closing the second port when the air is expelled from the interior cavity; and closing the isolation valve to seal the inert gas in the interior cavity. Closing the second port may comprise installing a plug in the second port. The method may further comprise decoupling the source of inert gas from the first port after closing the isolation valve. The method may further comprise closing the first port after decoupling the source of inert gas from the first port by installing a plug in the first port. The inert gas may comprise nitrogen. The downhole tool may be configured for conveyance in a borehole via at least one of a wireline or a drillstring. Closing the isolation valve to seal the inert gas in the interior cavity may be performed after a sufficient amount of the inert gas is flowed into the interior cavity to displace and expel substantially all airborne pollutants from the interior cavity. Closing the isolation valve may be performed after the interior space is pressurized with the inert gas at a pressure greater than atmospheric pressure.

The present disclosure also introduces a method comprising: coupling a pressure source to a first port of a downhole tool, wherein the first port is adjacent a first end of the downhole tool and in fluid communication with an interior cavity of the downhole tool; changing a pressure of the interior cavity of the via the pressure source; and determining whether the interior cavity of the downhole tool is sealed based on an amount of pressure change in the interior cavity of the downhole tool. The method may further comprise closing a second port of the downhole tool, wherein the second port is adjacent a second end of the downhole tool and in fluid communication with the interior cavity of the downhole tool. Changing the pressure of the interior cavity may comprise reducing the pressure of the interior space to be less than atmospheric pressure. Determining whether the interior cavity of the downhole tool is sealed may comprise performing the determination following assembly of the downhole tool and prior to using the downhole tool in a borehole.

The present disclosure also introduces an apparatus comprising: a downhole tool having an interior cavity and first and second opposing ends of the interior cavity; a first port adjacent the first end and a second port adjacent the second end, wherein the first and second ports are fluidly coupled to the interior cavity, and wherein the second port is configured to expel a gas from the interior cavity; an isolation valve in fluid communication with the interior cavity and the first port, wherein the isolation valve is configured to enable the interior cavity to be filled with an inert gas; and a plug configured to close the second port after the interior cavity is filled with the inert gas. The downhole tool may be configured for conveyance in a borehole via at least one of a wireline or a drillstring. The apparatus may further comprise an electronic circuit disposed in the interior cavity. The first end of the downhole tool may be a pin end and the second end of the downhole tool may be a box end. The isolation valve may be configured to be manually closed after the plug closes the second port. The apparatus may further comprise a second plug configured to close the first port after the isolation valve is closed. The apparatus may further comprise an upper head portion configured to include the isolation valve and the first port. The apparatus may further comprise a lower head portion configured to include the second port.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

opening an isolation valve of a downhole tool, wherein the isolation valve is in fluid communication with first and second ports of the downhole tool, and wherein the first and second ports are in fluid communication with respective first and second ends of an interior cavity of the downhole tool;

coupling a source of inert gas to the first port and flowing the inert gas into the interior cavity of the downhole tool to expel air from the interior cavity through the second port;

closing the second port when the air is expelled from the interior cavity, wherein closing the second port comprises installing a plug in the second port; and closing the isolation valve to seal the inert gas in the interior cavity.

2. The method of claim 1 further comprising decoupling the source of inert gas from the first port after closing the isolation valve.

3. The method of claim 2 further comprising closing the first port after decoupling the source of inert gas from the first port by installing a plug in the first port.

4. The method of claim 1 wherein the inert gas comprises nitrogen.

5. The method of claim 1 wherein the downhole tool is configured for conveyance in a borehole via at least one of a wireline or a drillstring.

6. The method of claim 1 wherein closing the isolation valve to seal the inert gas in the interior cavity is performed after a sufficient amount of the inert gas is flowed into the interior cavity to displace and expel substantially all airborne pollutants from the interior cavity.

7. The method of claim 1 wherein closing the isolation valve is performed after the interior space is pressurized with the inert gas at a pressure greater than atmospheric pressure.

8. A method, comprising:

coupling a pressure source to a first port of a downhole tool, wherein the first port is adjacent a first end of the downhole tool and in fluid communication with an interior cavity of the downhole tool;

changing a pressure of the interior cavity of the via the pressure source; and determining whether the interior cavity of the downhole tool is sealed based on an amount of pressure change in the interior cavity of the downhole tool, wherein determining whether the interior cavity of the downhole tool is sealed comprises performing the determination following assembly of the downhole tool and prior to using the downhole tool in a borehole.

9. The method of claim 8 further comprising closing a second port of the downhole tool, wherein the second port is adjacent a second end of the downhole tool and in fluid communication with the interior cavity of the downhole tool.

10. The method of claim 8 wherein changing the pressure of the interior cavity comprises reducing the pressure of the interior space to be less than atmospheric pressure.

11. An apparatus, comprising:

a downhole tool having an interior cavity and first and second opposing ends of the interior cavity;

a first port adjacent the first end and a second port adjacent the second end, wherein the first and second ports are fluidly coupled to the interior cavity, and wherein the second port is configured to expel a gas from the interior cavity;

an isolation valve in fluid communication with the interior cavity and the first port, wherein the isolation valve is configured to enable the interior cavity to be filled with an inert gas; and a plug configured to close the second port after the interior cavity is filled with the inert gas.

12. The apparatus of claim 11 wherein the downhole tool is configured for conveyance in a borehole via at least one of a wireline or a drillstring.

13. The apparatus of claim 11 further comprising an electronic circuit disposed in the interior cavity.

14. The apparatus of claim 11 wherein the first end of the downhole tool is a pin end and the second end of the downhole tool is a box end.

15. The apparatus of claim 11 wherein the isolation valve is configured to be manually closed after the plug closes the second port.

16. The apparatus of claim 15 further comprising a second plug configured to close the first port after the isolation valve is closed.

17. The apparatus of claim 11 further comprising an upper head portion configured to include the isolation valve and the first port.

18. The apparatus of claim 11 further comprising a lower head portion configured to include the second port.

19. A method, comprising:

opening an isolation valve of a downhole tool, wherein the isolation valve is in fluid communication with first and second ports of the downhole tool, and wherein the first and second ports are in fluid communication with respective first and second ends of an interior cavity of the downhole tool;

coupling a source of inert gas to the first port and flowing the inert gas into the interior cavity of the downhole tool to expel air from the interior cavity through the second port;

closing the second port when the air is expelled from the interior cavity;

closing the isolation valve to seal the inert gas in the interior cavity;

decoupling the source of inert gas from the first port after closing the isolation valve; and closing the first port after decoupling the source of inert gas from the first port by installing a plug in the first port.

* * * * *